US011987425B2

(12) United States Patent
Lalier

(10) Patent No.: US 11,987,425 B2
(45) Date of Patent: May 21, 2024

(54) FLIP TOP CLOSURE AND CONTAINER

(71) Applicant: Conopco, Inc., Englewood Cliffs, NJ (US)

(72) Inventor: Gregory Lalier, Brookfield, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 107 days.

(21) Appl. No.: 17/275,301

(22) PCT Filed: Sep. 9, 2019

(86) PCT No.: PCT/EP2019/074004
§ 371 (c)(1),
(2) Date: Mar. 11, 2021

(87) PCT Pub. No.: WO2020/058023
PCT Pub. Date: Mar. 26, 2020

(65) Prior Publication Data

US 2022/0112006 A1 Apr. 14, 2022

(30) Foreign Application Priority Data

Sep. 17, 2018 (EP) ..... 18194762

(51) Int. Cl.
*B65D 47/08* (2006.01)
*B65D 50/04* (2006.01)

(52) U.S. Cl.
CPC ..... *B65D 47/0838* (2013.01); *B65D 50/045* (2013.01); *B65D 2251/1025* (2013.01); *B65D 2251/1058* (2013.01)

(58) Field of Classification Search
CPC ..... B65D 47/0838; B65D 50/045; B65D 2251/1025; B65D 2251/1058
(Continued)

(56) References Cited

U.S. PATENT DOCUMENTS 4,011,940 A * 3/1977 Neal ..... G11B 23/0233 206/472
4,016,996 A 4/1977 Aichinger et al.
(Continued)

FOREIGN PATENT DOCUMENTS

CN 1284925 2/2001
CN 1477033 2/2004
(Continued)

OTHER PUBLICATIONS

Search Report and Written Opinion in EP18159378: dated Sep. 10, 2018.

(Continued)

*Primary Examiner* — James N Smalley
(74) *Attorney, Agent, or Firm* — Gerard J. McGowan, Jr.

(57) ABSTRACT

A closure (10) of the flip-top type, and a closure combined with a bottle or other container The closure comprises a cap base (12) which can be releasably fastened to a package (74), the cap base including an opening. A closing flap (16) is movably attached to the cap base and is suitable, when it is in a closed position, for preventing egress of a liquid from the package through the cap base opening. The closing flap has a locking flap extending therefrom, and movably attached to the closing flap. A locking flap fastener (70) is provided for releasably securing the locking flap to the cap base or to the package to prevent inadvertent opening of the closure during transport and use by the consumer. The locking flap (38) may be tucked within the closing flap during normal use and used to lock the closing flap during transport. The locking flap may be disposed in a recess (20) in the cap base.

10 Claims, 6 Drawing Sheets

(58) Field of Classification Search
USPC ..... 220/831–835; 215/228, 237
See application file for complete search history.

(56) References Cited

U.S. PATENT DOCUMENTS

| | | | | |
|---|---|---|---|---|
| 4,022,352 | A | 5/1977 | Pehr | |
| 4,209,100 | A | 6/1980 | Uhlig | |
| 4,253,581 | A | 3/1981 | Aichinger et al. | |
| 4,487,324 | A | 12/1984 | Ostrowsky | |
| 4,533,058 | A | 8/1985 | Uhlig | |
| 5,201,440 | A * | 4/1993 | Gross | B65D 47/0861 222/541.9 |
| 5,236,107 | A | 8/1993 | Spaanstra | |
| 5,251,793 | A | 10/1993 | Bolen, Jr. et al. | |
| 5,261,650 | A | 11/1993 | Hein | |
| 5,284,264 | A | 2/1994 | Gross | |
| 5,314,093 | A | 5/1994 | Gross | |
| 5,346,100 | A | 9/1994 | Lay | |
| 5,395,015 | A | 3/1995 | Bolen, Jr. et al. | |
| 5,622,284 | A | 4/1997 | Sawicki | |
| 5,709,318 | A | 1/1998 | Oder | |
| 5,839,621 | A | 11/1998 | Tada | |
| 5,875,907 | A * | 3/1999 | Lay | B65D 47/0804 215/901 |
| 5,918,777 | A | 7/1999 | Flak | |
| 5,967,384 | A | 10/1999 | Mengeu et al. | |
| 5,971,232 | A | 10/1999 | Rohr | |
| 6,029,866 | A | 2/2000 | Wood et al. | |
| 6,152,329 | A | 11/2000 | Rosenthal et al. | |
| 6,343,725 | B1 | 5/2002 | Lohrman | |
| 6,896,160 | B2 | 5/2005 | Kaufman et al. | |
| 6,971,547 | B2 | 12/2005 | Englert | |
| 7,404,495 | B2 | 7/2008 | Keung | |
| D587,969 | S | 3/2009 | Gilbert | |
| D624,357 | S | 9/2010 | George | |
| 7,870,969 | B2 | 1/2011 | Ribadeneira Mejia | |
| 7,975,883 | B2 | 7/2011 | Laib et al. | |
| 8,074,849 | B2 | 12/2011 | Domoy | |
| 8,167,156 | B2 | 5/2012 | Milante | |
| D690,559 | S | 10/2013 | Lane | |
| 8,590,735 | B2 | 11/2013 | Ward | |
| 8,689,989 | B2 | 4/2014 | Lane | |
| 8,960,490 | B2 | 2/2015 | Carlile | |
| D748,949 | S | 2/2016 | Long, Sr. | |
| D749,363 | S | 2/2016 | Tacker et al. | |
| 9,637,626 | B2 | 5/2017 | Domoy et al. | |
| 9,914,567 | B2 | 3/2018 | Brem et al. | |
| 10,689,169 | B1 | 6/2020 | Meshberg | |
| 10,699,082 | B2 | 6/2020 | Meshberg | |
| 2004/0036229 | A1 | 2/2004 | Takahashi et al. | |
| 2004/0112927 | A1 | 6/2004 | Kaufman | |
| 2004/0026465 | A1 | 12/2004 | Kiopfer | |
| 2005/0190070 | A1 | 9/2005 | Rudduck et al. | |
| 2006/0231518 | A1 | 10/2006 | Suffa | |
| 2007/0075030 | A1 | 4/2007 | Venneri | |
| 2008/0110938 | A1 | 5/2008 | Sternberg | |
| 2008/0190952 | A1 | 8/2008 | Strub | |
| 2014/0048549 | A1 | 2/2014 | Wille | |
| 2014/0034644 | A1 | 6/2014 | Wahl | |
| 2016/0200485 | A1 | 7/2016 | Quinones et al. | |
| 2016/0297583 | A1 | 10/2016 | Staeben | |
| 2018/0127179 | A1 | 5/2018 | Port et al. | |
| 2019/0002164 | A1 | 1/2019 | Hisahiro et al. | |
| 2019/0092539 | A1 | 3/2019 | Phillips | |

FOREIGN PATENT DOCUMENTS

| | | |
|---|---|---|
| CN | 1507404 | 6/2004 |
| CN | 101549769 | 10/2009 |
| CN | 101646609 | 2/2010 |
| CN | 103284450 | 9/2013 |
| CN | 105197382 | 12/2015 |
| CN | 105492332 | 4/2016 |
| CN | 105905422 | 8/2016 |
| CN | 207725951 | 8/2018 |
| DE | 20118537 | 1/2003 |
| EP | 0926075 | 6/1999 |
| EP | 0990593 | 9/1999 |
| EP | 1460000 | 9/2004 |
| EP | 2559632 | 2/2013 |
| EP | 2424785 | 3/2013 |
| FR | 2771386 | 5/1999 |
| GB | 2231036 | 11/1990 |
| JP | S52021989 | 2/1977 |
| JP | 4053658 | 5/1992 |
| JP | 9291879 | 11/1997 |
| JP | 200323158 | 8/2003 |
| JP | 2005047567 | 2/2005 |
| JP | 2014094044 | 5/2014 |
| JP | 2018090285 | 6/2018 |
| RU | 2657225 | 6/2018 |
| WO | WO8903363 | 4/1989 |
| WO | WO9422733 | 10/1994 |
| WO | WO9516633 | 6/1995 |
| WO | WO9732791 | 9/1997 |
| WO | WO9936328 | 7/1999 |
| WO | WO0242174 | 5/2002 |
| WO | WO03086891 | 10/2003 |
| WO | WO2004054921 | 7/2004 |
| WO | WO2004071882 | 8/2004 |
| WO | WO2011022795 | 3/2011 |
| WO | WO2012110335 | 8/2012 |
| WO | WO2017046186 | 3/2017 |
| WO | WO2019129567 | 7/2019 |

OTHER PUBLICATIONS

Search Report and Written Opinion in PCTEP2018085791; dated Mar. 11,2019.

Search Report and Written Opinion in EP18194762; dated Mar. 22, 2019.

Search Report and Written Opinion in EP19155612; dated Aug. 30, 2019.

Search Report and Written Opinion in PCTEP2019074004; dated Nov. 19, 2019.

Search Report and Written Opinion in PCT/EP2020/050230; dated May 15, 2020.

Co-pending U.S. Appl. No. 16/957,370, filed Jun. 23, 2020, entitled CLOSURE.

* cited by examiner

FLIP TOP CLOSURE AND CONTAINER

BACKGROUND OF THE INVENTION

The integrity of closures on bottles and other containers has always been a concern to consumer goods manufacturers. Leakage of product during shipping can be a costly problem. Also, leakage of product in the hands of consumers is not conducive to repeat purchases.

Leakage concerns are magnified in the current world of e-commerce. It is somewhat easier to ensure intact shipment of large numbers of bottles together than it is to protect a product from leakage during shipment of individual bottles from e-commerce retailers or even during e-commerce shipment from the manufacturer. Likewise, transport of a container by a consumer after she has opened it can be problematic and result in product leakage in, for example a suitcase being used on a vacation.

A popular type of closure for consumer goods such as shampoos, body washes, skin creams, etc. is the flip-top closure wherein a hinged flap rotates between an open and a closed position. With this and other types of closures, care needs to be taken to ensure that the flap does not unexpectedly open during shipment.

Various types of flip top and other types of closures are described in the literature. Long et al. U.S.D748949, Tacker et al. U.S.D749363, Lane U.S.D690559, George U.S.D624357 and Gilbert U.S.D 587969 disclose designs for containers and/or closures.

Uhlig U.S. Pat. No. 4,533,058 discloses a one piece molded thermoplastic child-resistant dispensing closure. The top of the closure includes a recess to receive a sealing flap.

Wahl US patent application publication no. 2014/0034644 discloses a beverage container or flask which includes a lower body portion and a selectively openable upper body portion. The upper body portion is configured to include a fastener that allows a user to selectively lock the panel in place by pivoting the upper body portion relative to the remainder of the flask.

Laburu EP 255632 discloses a sealing cap.

Wille US2014048549 is directed to a container having a lid with a closure having at least three positions.

Habermann EP 1460000 discloses a lockable hinged closure, and Klopfer US2004/0026465 discloses a hinged closure.

FR2771386 relates to a closure that is attached to a product container and has a cap that can move between a first open position where it allows the product to be dispensed, and a second closed position where it prevents the flow of product. The cap has a tab permanently attached to it and in the closed position this tab lies in a level area of the closure without protruding so as to prevent inadvertent opening of the cap in the event of a shock being applied to it.

SUMMARY OF THE INVENTION

The invention is directed to a closure of the flip-top type and to the closure combined with a bottle or other container.

The closure comprises a cap base which can be releasably fastened to a package, the cap base including an opening. A closing flap is movably attached to the cap base and is suitable, when it is in a closed position, for preventing egress of a liquid from the package through the cap base opening.

Portions of the cap base constitute a barrier which together with the closing flap are suitable for preventing egress of the liquid from the package.

The closing flap has a locking flap extending therefrom, preferably from one end, and movably attached to the closing flap. A locking flap fastener is provided for releasably securing the locking flap to the cap base or to the package to prevent inadvertent opening of the closure during transport and use by the consumer.

In a first embodiment, the closing flap has a bottom surface contacting the cap base when the closing flap is in the closed position, and the locking flap has at least a first (A) and a second (B) alternative position when the closing flap is in the closed position. Position (A) is below the closing flap bottom surface and internal to the closing flap and position (B) is external to the closing flap whereby the locking flap can be fastened to the package or the cap base. In position A, the locking flap is tucked under the closing flap and in such position the closure may be more convenient for the consumer to use in day to day operation when inadvertent opening during transport is of no, or diminished, concern. In a second embodiment, which may be combined with the first embodiment, the cap base includes a recess in a top surface thereof. A closing flap is movably attached to the cap base and is received within the cap base recess when in the closed position and suitable for preventing egress of a liquid from the package through the opening when in the closed position. A locking flap extends from the closing flap for releasably securing the closing flap in the closed position. If desired, as in the first embodiment, the locking flap may alternatively be tucked under the closing flap when the closing flap is in the closed position. In the second embodiment, the closing flap is received within the cap base recess when it is in the closed position and the locking flap may be tucked under the closing flap.

The closing flap is preferably attached to the cap base using a living hinge. Likewise, the locking flap is preferably attached to the closing flap using a living hinge.

For a more complete understanding of the above and other features and advantages of the invention, reference should be made to the following detailed description of preferred embodiments and to the accompanying drawings.

DETAILED DESCRIPTION OF THE INVENTION

Figure 1:
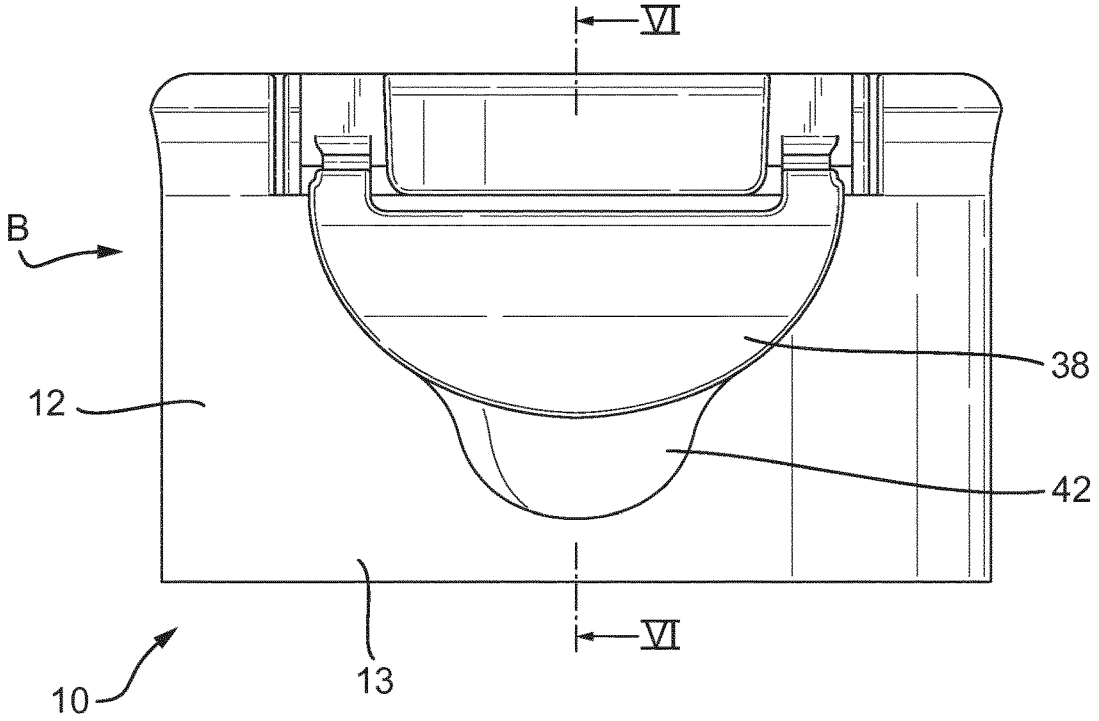
FIG. 1 is a front elevational view of a closure according to the invention.

Closure 10 comprises cap base 12. Cap base 12 includes top surface 14 and cylindrical skirt 13 depending from the top surface. Skirt 13 includes semicircular recess 40, which is shaped to receive the locking flap, as will be explained hereinafter. Recess 40 includes aperture 44. Below recess 40 and aperture 44 is finger access recess 42 which permits the consumer readily to unlock locking flap 38.

Closing flap 16 is formed in surface 14 and is movable and pivotably attached to cap base 12 by living hinges 18. Placing closing flap 16 in the open position reveals recess 20 in top surface 14 of cap base 12. Recess 20 is defined by side walls 56 which depend from surface 14 and by recess platform 60, in which opening 24 is disposed. It will be apparent that platform 60 and surface 14 will constitute barriers to egress of liquid from a package to which closure 12 has been fastened. Closing flap 16 includes platform 22 which is a continuation of top surface 14. Platform 22 includes depending cylindrical plug 26. Closing flap sidewalls 28 depend from platform 22 on each side thereof.

At the opposite end to that at which it is attached with living hinges 18, closing flap 16 includes recesses 30, 32 which receive living hinges 34, 36 by which locking flap 38 is attached. Locking flap 38 pivots on hinges 34, 36 at least between position (A) wherein it is tucked in within closing flap side walls 28 and proximate platform 16, and position (B) wherein it is positioned to releasably secure the closing flap. In position (A), locking flap 38 contacts ribs 50 in the underside of platform 22 and is retained in the stowed position by tab 64 which is attached to platform 22. Locking flap 38 may be snapped under tab 64 or retained by other locking structures.

Locking flap 38 includes recess 48 which affords clearance for the locking flap to pivot without interference from the proximate end of the closing flap. Locking flap 38 includes an arm or other extension member 70 which snap fits within aperture 44 when locking flap is in the locked position shown in FIG. 2.

Figure 7:
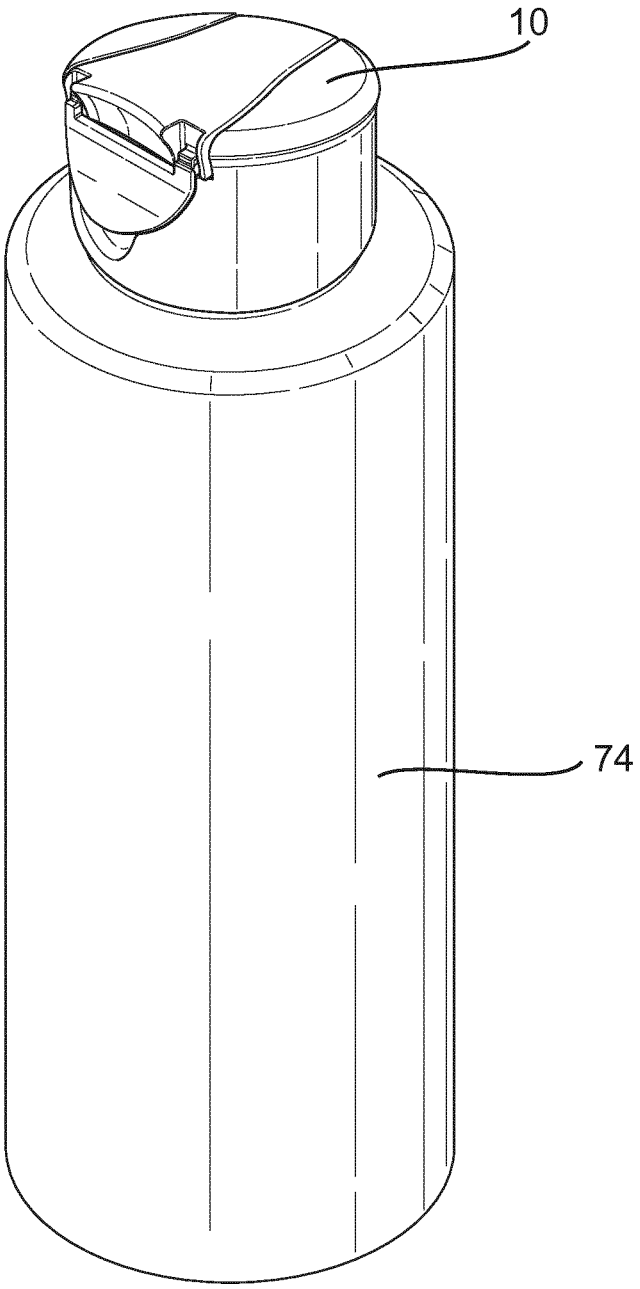
FIG. 7 is a perspective view of a combined bottle and closure according to the invention.

Typically, the closure 10 of the invention will be fastened to bottle 74 or other package, as is evident from FIG. 7. Fasteners (not shown) will typically be present on the underside of the closure and may include screws or snap fit mechanisms such as debossments, embossments, etc. Mating screws or other fastening structures can be present on the bottle neck.

In operation, during shipping of the package with the closure fastened thereto, closing flap 16 and locking flap 38 are in their closed, locked positions, such as may be seen in FIG. 1. In its closed position, closing flap 16 is received within recess 20 and cylindrical plug 26 is tightly and lockingly releasably received within opening 24. The diameter of plug 26 may be slightly greater than that of opening 24 to provide a snap fit. Plug 26 together with cap base 12 prevent egress of liquid from bottle 74 or other package.

Figure 2:
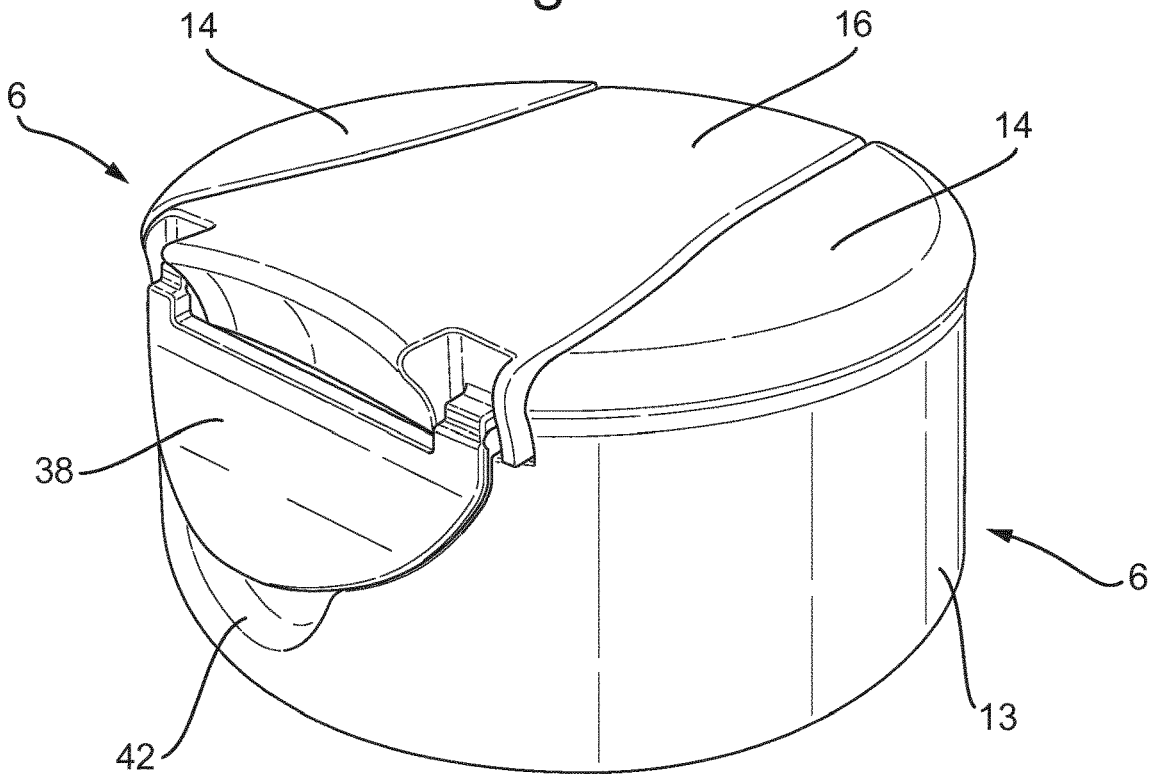
FIG. 2 is a perspective view from above and the right of a closure according to the invention with the closing flap in the closed position.
Figure 3:
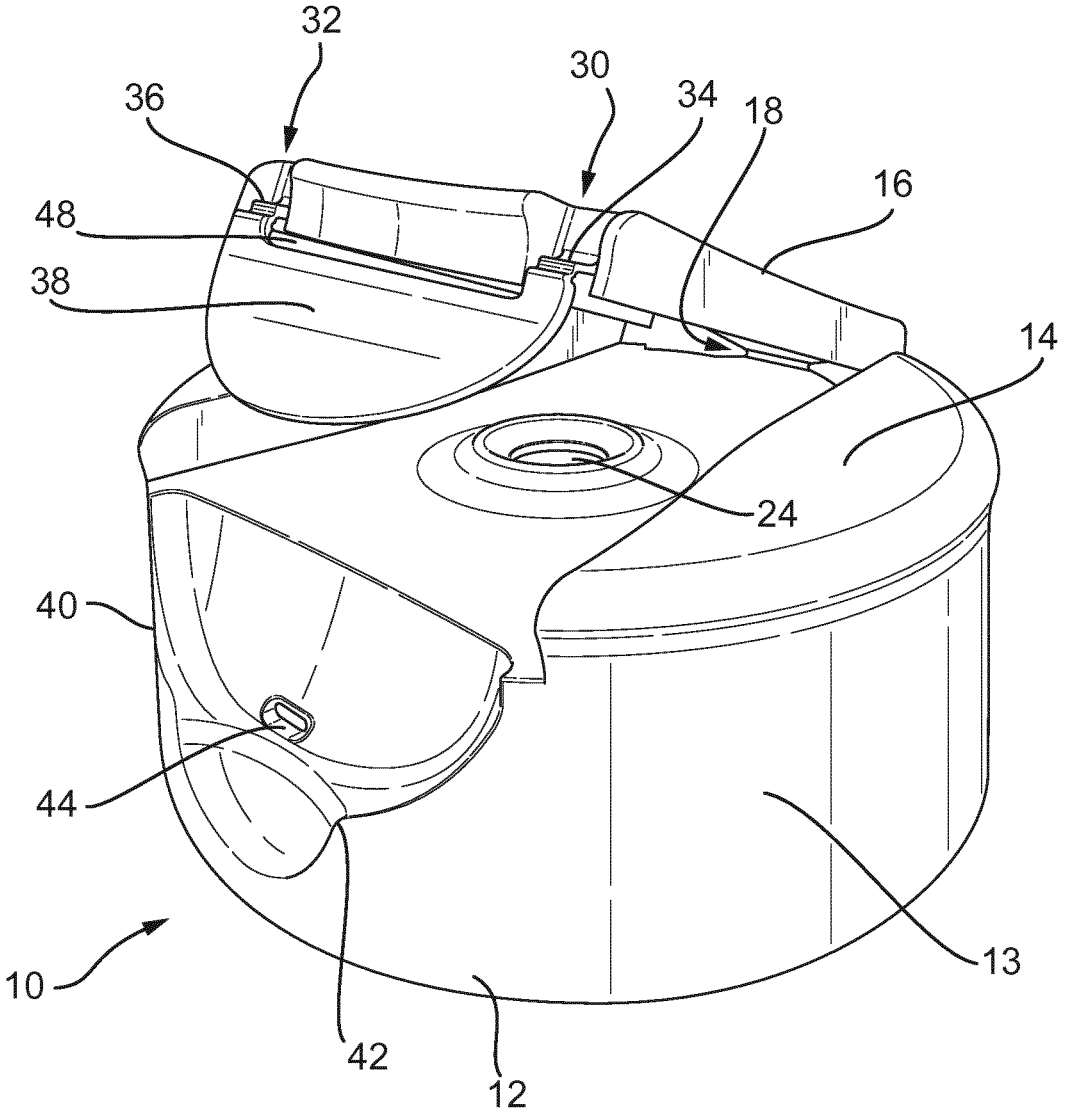
FIG. 3 is a perspective view of the closure of FIG. 2 wherein the closing flap is partially open.

For shipping, it is preferred that locking flap 38 is in its locked position seen in FIGS. 1 and 2 (designated "B" in FIG. 1) and that the extension member 70 of the locking flap is engaged with and received within aperture 44 to help retain closing flap 16 in it closed position. The closure can readily be opened by inserting a finger underneath the locking flap using the extra space afforded by recess 44.

Plug 26 acts as a retainer to retain the closing flap in its closed position.

Transport via e-commerce often entails shipping products in individual packages which may be less secure than the product pallets often used by manufacturers in transporting large numbers of products. The present closure affords an extra measure of protection against inadvertent opening of the closing flap in response to the additional stresses to which packages are subjected during e-commerce transport.

Figure 4:
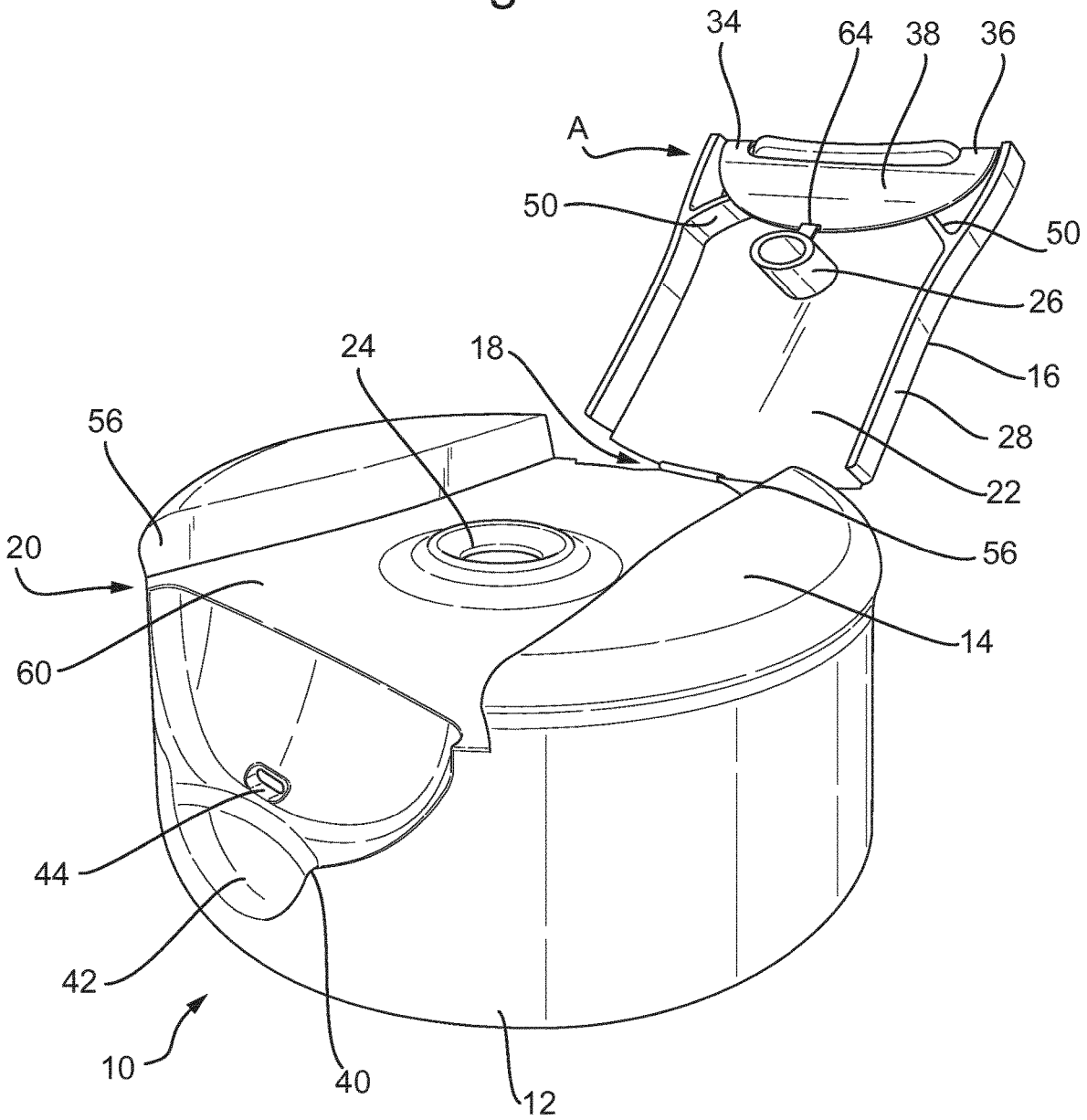
FIG. 4 is a perspective view of the closure of FIG. 2 with the closing flap open and the locking flap tucked within the closing flap.
Figure 5:
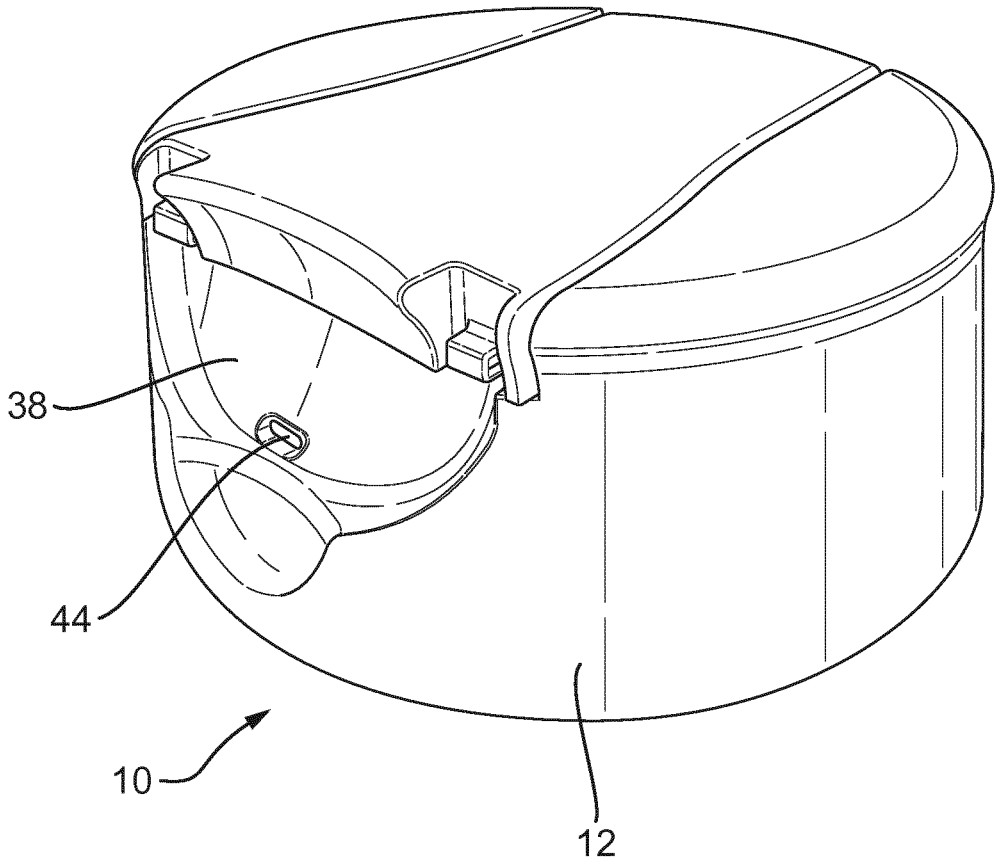
FIG. 5 is a perspective view of the closure of FIG. 1 wherein the closing flap is in the closed position but the locking flap is tucked within the closing flap.
Figure 6:
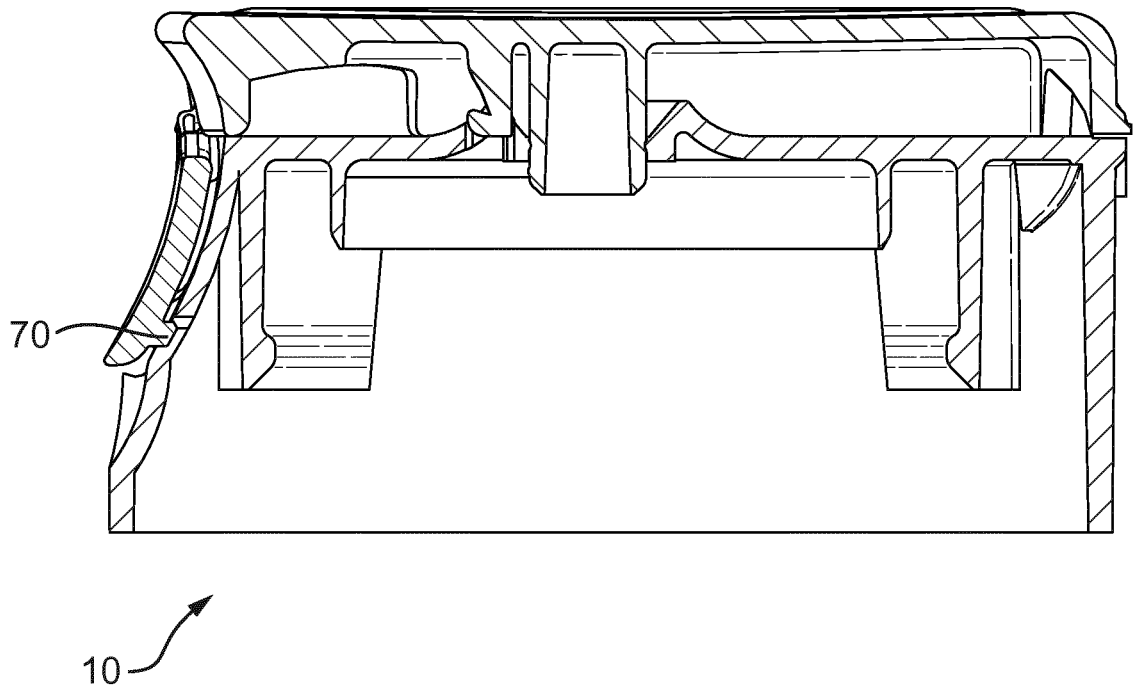
FIG. 6 is a cross section along the lines 6-6 of FIG. 1.

The additional protection against inadvertent opening provided by the invention requires an extra step of locking the locking flap, which may not be necessary or desirable in day-to-day, household use of the product. On the other hand, the consumer may wish to take advantage of the possibility of such extra protection when travelling on business, vacation or otherwise. Therefore, the closure of the invention provides the option to temporarily stow the locking flap so that it does not interfere with ordinary use while, at the same time, remaining available should the consumer wish to enjoy the extra protection which it affords when it is necessary to transport the package or for other situations of anticipated rough handling. Stowing the locking flap 38 can be achieved by rotating it so that it rests against ribs 50 and is retained by tab 64 (e.g., position "A" in FIG. 4).

With the locking flap in the stowed position, the consumer can open and close the closing flap without interference or involvement by the locking flap. In particular, the extra step of snapping shut the locking flap every time the closure is closed is avoided. The releasable engagement of the closing flap with the cap base, e.g., through snap fitting of cylindrical plug 26 into opening 24, is expected to be sufficient to keep the closure from opening in normal use. If it is desired to utilize the locking flap again, e.g., when transporting the package during travel, locking flap 38 can simply be pulled away from tab 64, leaving it free to rotate on hinges 34, 36 and available for locking the closing flap by inserting the arm or other extension member 70 into aperture 44 (or using other locking mechanisms) as needed.

Generally, the attachments of the closing flap to the cap base and of the locking flap to the closing flap will not be releasable attachments, i.e., will not be attachments which can be readily severed by moderate force by the consumer without employing tools such as a pair of scissors.

The adaptor and living hinge will typically be made of polypropylene or polyethylene. Post-consumer polypropylene may be included as well. The adaptor and/or living hinge may also be made from the hinge material described in Domoy et al. U.S. Pat. No. 9,637,626, namely a molded article having a hinge, the molded article being a polymer, the polymer comprising a mixture of a first high-density polyethylene (HDPE) resin and a second HDPE resin, that is different than the first HDPE, wherein, when mixed: the first high-density polyethylene (HDPE) resin has:

a. a Melt Index ($I_{2,16}$) of about 0.5 dg/min to 10 dg/min, b. a Density of about 0.940 g/cm3 to 0.968 g/cm3, and c. a Melt Flow Ratio ($I_{21.6}$:$I_{2.16}$) greater than about 25; and the second HDPE resin has a Melt Flow Ratio ($I_{21.6}$:$I_{2.16}$) of less than about 30. The disclosure of Domoy et al. U.S. Pat. No. 9,637,626 is hereby incorporated by reference herein. The closure will generally be fabricated using injection molding.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

The invention claimed is:

1. A closure comprising a) a cap base including a barrier to egress of liquid from a package and including i) an opening, and ii) a fastener for fastening the cap base to the package, b) a closing flap movably attached to the cap base and when it is in a closed position suitable for preventing egress of a liquid in the package through the opening and together with the cap base suitable for preventing egress of the liquid from the package, c) the closing flap having a locking flap extending from an end thereof and movably attached to the closing flap, d) the closing flap including a closing flap retainer for releasably securing the closing flap to the cap base, the closing flap including a platform from which depends sidewalls on each side thereof;

e) the closing flap having a bottom surface contacting the cap base when the closing flap is in the closed position, f) the locking flap having a locking flap fastener for releasably fastening the locking flap to one or both of the package or the cap base (12), g) the locking flap having at least first (A) and a second (B) alternative positions when the closing flap is in the closed position, position (A) being below the closing flap bottom surface and internal to the closing flap, the locking flap being tucked within the closing flap side walls in position (A), and position (B) being external to the closing flap whereby the locking flap can be fastened to the package or the cap base, and wherein after being in the stowed position, the locking flap is available for locking the closing flap if it is desired to again lock the closing flap.

2. The closure according to claim 1, wherein the closing flap is pivotably attached to the cap base at one end of the closing flap and wherein the locking flap extends from a second end of the closing flap opposite the first end.

3. The closure according to claim 1, wherein the locking flap fastener comprises an extension which can be snap fit into an aperture on the cap base to releasably secure the locking flap onto the cap base.

4. The closure according to claim 1, where the locking flap is attached to the closing flap by one or more hinges.

5. The closure according to claim 4 wherein at least one said hinge is received within a recess on the closing flap.

6. The closure according to claim 1, releasably fastened to a package.

7. A closure according to claim 1, further comprising a recess in a top surface of the cap base, wherein the closing flap is received within the cap base recess when the closing flap is in the closed position.

8. The closure according to claim 1, wherein the locking flap is non-releasably attached to the closing flap.

9. The closure according to claim 1 wherein in position (A), the locking flap is retained in a stowed position by a tab which is attached to the platform.

10. The closure according to claim 1 wherein in position (A), the locking flap is retained in a stowed position by a locking structure.

* * * * *